US005312053A

United States Patent [19]

Ganser, IV

[11] Patent Number: 5,312,053

[45] Date of Patent: May 17, 1994

[54] CONE CRUSHER WITH ADJUSTABLE STROKE

[75] Inventor: William A. Ganser, IV, Eugene, Oreg.

[73] Assignee: Cedarapids, Inc., Cedar Rapids, Iowa

[21] Appl. No.: 1,447

[22] Filed: Jan. 7, 1993

[51] Int. Cl.[5] ..... B02C 2/04

[52] U.S. Cl. ..... 241/30; 241/213; 241/215

[58] Field of Search ..... 241/30, 215, 213, 286

[56] References Cited

U.S. PATENT DOCUMENTS

| | | | |
|---|---|---|---|
| 463,538 | 11/1891 | McCully | 241/213 |
| 1,436,338 | 11/1922 | Carman | 241/215 |
| 1,748,484 | 2/1930 | Kennedy | 241/215 |
| 2,486,478 | 11/1949 | Kennedy | 241/215 X |
| 2,972,448 | 2/1961 | Dorsey | 241/286 |
| 3,133,706 | 5/1964 | Meitz | 241/37 X |
| 3,133,707 | 5/1964 | Zimmerman . | |
| 3,140,835 | 7/1964 | Balmer et al. | 241/286 |
| 3,142,449 | 7/1964 | Balmer | 241/286 |
| 3,420,457 | 1/1969 | Peters et al. | 241/286 X |
| 3,599,883 | 8/1971 | Pollak . | |
| 3,700,175 | 10/1972 | Saito . | |
| 3,788,569 | 1/1974 | Kemnitz . | |
| 3,801,026 | 4/1974 | Decker et al. . | |
| 3,837,585 | 9/1974 | Decker et al. | 241/213 |
| 4,034,922 | 7/1977 | Coxhill . | |
| 4,147,309 | 4/1979 | Vroom . | |
| 4,272,030 | 6/1981 | Afanasiev et al. . | |
| 4,391,414 | 7/1983 | Reiter | 241/213 |
| 4,477,031 | 10/1984 | Alford . | |
| 4,478,373 | 10/1984 | Gieschen . | |
| 4,566,638 | 1/1986 | Lundin et al. . | |
| 4,697,745 | 10/1987 | Sawant et al. . | |
| 5,152,468 | 10/1992 | Virtamo et al. | 241/215 X |
| 5,190,229 | 3/1993 | Kaiser | 241/215 X |

FOREIGN PATENT DOCUMENTS

| | | | |
|---|---|---|---|
| 672080 | 10/1963 | Canada | 241/213 |
| 676798 | 12/1963 | Canada | 241/213 |
| 7987 | 5/1884 | United Kingdom | 241/213 |
| 16834 | 9/1894 | United Kingdom | 241/213 |

OTHER PUBLICATIONS

"Hydrocone Crushers", Product Brochure by Allis--Chalmers.

"Handbook of Heavy Construction," First Edition, 1959, McGraw-Hill Book Company, Inc. Frank W. Stubbs, Editor-in-Chief, pp. 9-54, 9-55, 9-58, 9-59.

*Primary Examiner*—Mark Rosenbaum

*Assistant Examiner*—Frances Han

*Attorney, Agent, or Firm*—Simmons, Perrine, Albright & Ellwood

[57] ABSTRACT

A gyratory crusher includes a bowl assembly with a concave crushing surface and a crusher head of conical shape which extends into the concave portion of the bowl assembly. A central crusher axis extends centrally through the bowl assembly. The crusher head is mounted with a central head axis at an angular deviation with respect to the central crusher axis to intersect the crusher axis at an apex. Crushing action is obtained by driving the crusher head to gyrate the angular offset of its central axis about the central crusher axis. The gyratory crusher has an adjustable stroke of gyration. Adjustability of the stroke is obtained by controllably varying the amount of angular deviation by which the crusher head gyrates about the central crusher axis. The amount of angular deviation is controlled by an eccentric support bearing which gyrates a guide shaft of the crusher head about the crusher axis and which is adjustably mounted to move toward and away from the apex of gyration without also changing the position of the crusher head with respect to the apex.

16 Claims, 2 Drawing Sheets

CONE CRUSHER WITH ADJUSTABLE STROKE

BACKGROUND OF THE INVENTION

The invention relates to gyratory crushers and particularly to the gyratory motion mechanism of gyratory crushers.

The invention may be best understood in consideration of generally understood operating characteristics of gyratory crushers. Gyratory crushers or cone crushers are those which support a cone-shaped crushing head capable of undergoing a gyrating motion centered generally about a vertical central axis through the crusher. The gyrating motion of the crushing head performs a crushing action on material which enters a space between the head and an inner surface of a concave or bowl-shaped stationary member. The bowl-shaped member is disposed in an inverted position generally over the cone-shaped crushing head. The bowl-shaped member is centered on the axis through the crusher and has a central opening through which materials, such as rock, ore, coal or the like are fed into the space between the crushing head and the stationary, bowl-shaped member. The action of the crusher typically distributes the materials annularly about the centrally disposed conical shape of the crushing head. The materials typical move by gravity into the annular space between the inner wall of the stationary bowl member and the outer, cone-like surface of the crushing head. The annular space between the bowl member and the crushing head is also referred to as the crushing chamber. The gyration of the crushing head causes the space at any specific radial position of the crusher to cyclically increase and decrease in width. The cyclic, relative motion of the two members comminutes the materials as they are drawn by gravity though the annular, downward sloping space to be discharged at the base of the crushing chamber.

Cone crushers are generally chosen to be optimally suited for specific operating conditions and materials. The shape of the crushing chamber, the angle of the conical head, the stroke (the difference between the extremes of gyratory movement of the crushing head), and the rotational speed of the gyratory drive are factors which are typically considered in the selection of a crusher. Selection of a crusher with optimum specifications including its size is often based on prior experience with the materials to be comminuted. For example, the hardness of rock or ore may limit the amount of reduction that can be achieved in a single path. Consequently, hard rock may require a stroke length on the short end of a range of typically specified gyration strokes. Such relatively short stroke may limit the material throughput rate or capacity of the crusher. On the other hand, a comparatively easier to crush or softer material or rock may permit a greater reduction during a single pass, hence a relatively longer stroke of the crusher may be specified. The relatively long stroke may, in general, also permit a greater material throughput.

For many commercial crushing applications, however, gyratory crushing plants are intended for use at many different locations. For example, road construction projects often require crushing operations at a number of successively accessed quarries. Each location may provide materials of different hardness. For crushers intended to produce under such variable conditions, it would generally not be possible to preselect operating specifications of the crusher to optimize the crusher for any particular source material. Instead, it appears desirable to have available a crusher which can be adjusted to work optimally with materials without much concern as to hardness or crushability. An ideal crusher would permit an operator to optimize crusher throughput and product quality at each new site, as for example by making sample runs and by fine tuning of certain adjustable operating parameters of the crusher.

For any given crusher size and type, the closed side setting (CSS) which is the least gap between the crusher head and the bowl, may not be less than a certain minimum setting at which the crusher begins to be overloaded. The CSS is typically adjustable by raising or lowering the bowl or stationary member with respect to the crusher head. According to some known crusher makes the crushing head may be raised or lowered to establish the CSS. The rotational speed of the crusher head may, of course, be changed. However, for any one crusher the throughput or production capacity of the crusher may not increase with an increase in the crusher speed. The production capacity of the crusher may even decrease slightly with a speed up in rotational speed.

The length of the stroke of the crusher, namely the difference between a maximum opening and a minimum opening at a given section through the space between the head and the bowl, does have an effect on the throughput of the crusher. The stroke length is typically established by the design of the crusher components, such as the amount of eccentricity in a camming member or sleeve which transforms rotational motion of a drive member into the desirable, gyrational motion of the crusher head. A cone crusher of a certain size when equipped with an eccentric member with increased eccentricity with respect to that of an original eccentric member, may show a marked increase in production capacity. A corresponding increase in the drive power or the rotational speed of the drive member may increase the power input to the crusher to accommodate the increased crushing action for a correspondingly improved production capacity. However, a comparatively longer stroke may not be optimally suited for relatively hard materials which require greater crushing force. Thus, typically a compromise stroke length is chosen which may not permit an ideal production rate in certain crushing operations.

SUMMARY OF THE INVENTION

From the foregoing it appears desirable to equip a gyrational crusher with an arrangement for adjusting the length of the crusher stroke. An ability to adjust the stroke of the crusher permits the operation of the crusher to become optimized to crush materials of various hardness or resistance to crushing.

In accordance with the invention, a gyratory crusher includes a stationary bowl assembly disposed centered on a crusher axis, and a crusher head assembly having a conical crusher head disposed for gyratory motion against a concave crushing liner of the bowl assembly. A gyration support assembly supports the crusher head for gyrational movement with respect to the bowl assembly. A gyration drive assembly includes an eccentric drive arrangement for driving the crusher head in a gyrational orbit about an apex on and at an angular deviation with respect to the central crusher axis to generate gyrating stroke of the crusher head with respect to the bowl assembly. A stroke control assembly includes a provision for changing the angular deviation of the crusher head to change the stroke of the crusher head with respect to the bowl assembly.

Various advantages of the invention and features of a preferred embodiment of the invention are set forth in a detailed description below.

BRIEF DESCRIPTION OF THE DRAWING

The Detailed Description including the description of a preferred structure as embodying features of the invention will be best understood when read in reference to the accompanying figures of drawing wherein.

DETAILED DESCRIPTION OF THE INVENTION

The Crusher Structure

Figure 1:
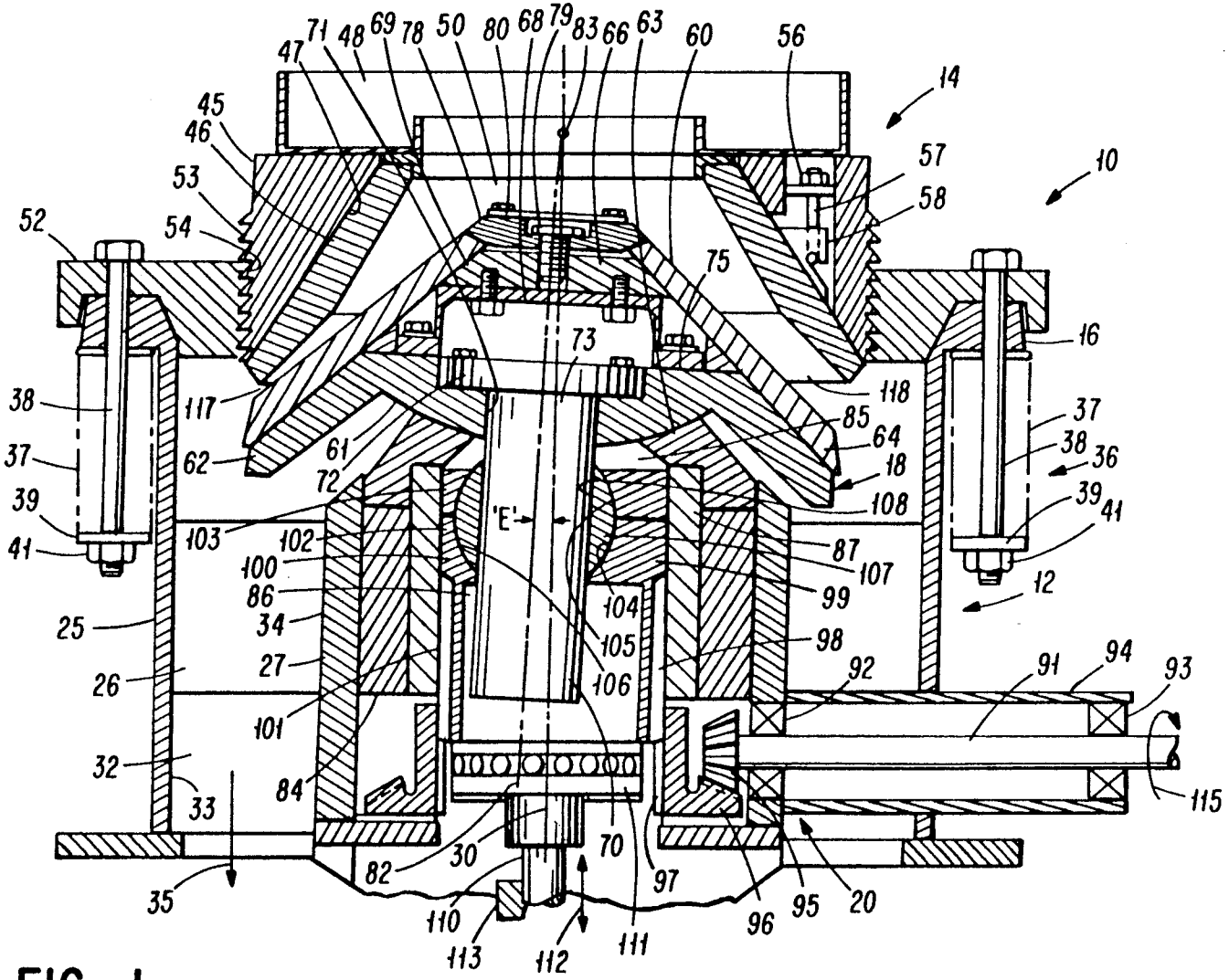
FIG. 1 is a broken vertical section through a gyratory crusher, showing major elements of the crusher as an embodiment of the invention.

In reference to FIG. 1, a gyratory crusher 10 includes broadly a frame assembly 12, a stationary bowl assembly 14 supported by an upper rim 16 of the frame assembly, a crusher head assembly 18 disposed below the bowl assembly 14, and a crusher drive assembly 20.

The frame assembly 12 substantially defines outer lateral dimensions of the crusher 10 and provides support for various structural and functional elements of the crusher 10. The frame assembly 12 is made up of distinguishable structural frame elements which are preferably welded to form a unitary frame structure and impart structural integrity to the frame assembly. A cylindrical outer shell 25 defines generally the outer dimension of the crusher 10. A number of spider support ribs 26 are vertically oriented plates 26 which extend radially between the outer shell 25 and an inner head support frame 27. The support ribs 26 are generally evenly spaced along the inside of the outer shell 25. The head support frame 27 is a cylindrical member which is disposed concentrically within the outer shell 25. A central vertical axis 30 through the outer shell 25 is common to a central axis of the inner head support frame 27 and also coincides with and constitutes a central axis 30 of the crusher 10.

An annular gap 32 defined by an inner surface 33 of the outer shell 25 and an outer surface 34 of the head support frame 27 provides a discharge region for crushed materials 35 falling from the crusher 10 as indicated by an arrow 35. It may be preferred to provide replaceable inner liners (not shown) adjacent each of the respective surfaces 33 and 34 to protect the surfaces 33 and 34 from abrasive action by the crushed materials 35.

The rim 16 of the frame assembly 12 constitutes a structurally reinforced seat 16 for the bowl assembly 14. The bowl assembly may be held centered in place against the seat 16 by an arrangement which permits the bowl assembly to temporarily raise itself from the seat 16 in yielding to excessive crushing forces. A yieldable hold-down of the bowl assembly 14 is particularly needed when non-crushable materials such as tramp iron passes through the crusher 10. A relief may be provided in any of a number of known ways, including hydraulic relief provisions. A yieldable arrangement may either lift the bowl assembly 14 as in the present example, or a hydraulic relief may cause the crusher head to deviate from a normal, circularly gyrating crushing path around the bowl assembly 14. FIG. shows a known spring relief arrangement 36. The arrangement 36 includes a plurality of compression springs 37. The springs 37 are seated on respective guide bolts 38 and are retained under a predetermined compressive force by tension washers 39 secured to lower ends of the guide bolts 38 by lock nuts 41. The guide bolts 38 and respective compression springs 37 of the arrangement 36 generally would be spaced evenly about the outer shell 25.

The stationary bowl assembly 14 includes a cylindrical crusher bowl 45. A bowl liner 46 is of concave shape and is attached to an inner, concave support surface 47 of the crusher bowl 45. A feed hopper 48 is shown as being mounted over a central feed port 50 through the bowl 45 and bowl liner 46. The feed hopper 48 may be part of the bowl assembly 14 or may be separate from the crusher 10. The feed hopper 48 is generally desirable as a liner to protect bowl 45 from abrasive contact with materials being fed through the feed port 50 into the crusher 10.

A bowl flange 52 peripherally supports the crusher bowl 45 with respect to the frame assembly 12. The bowl flange 52 also centers the bowl assembly 14 on the central axis 30 with respect to the crusher 10. Outer screw threads 53 on the crusher bowl 45 engage inner screw threads 54 on the bowl flange 52. By rotating the crusher bowl 45 with respect to the bowl flange 52, the crusher bowl 45 may be raised or lowered with respect to the crusher frame assembly 12. The vertical adjustment of the crusher bowl 45 establishes a gap setting between the crusher bowl 45 and the crusher head assembly 18. An initial setting of the crusher bowl 45 with respect to the crusher head assembly 18 may be changed to adjust for wear or to change a critical close side setting (CSS) as a result of a change in the length of the crusher stroke. It is understood that the rotational height adjustment of the crusher bowl 45 is but one known way to effect adjustments for wear. Other known crusher arrangements have effected such adjustments by maintaining the crusher bowl vertically stationary and by adjusting the head assembly toward or away from the crusher bowl. Such latter adjustment is conveniently done by hydraulic piston arrangements, particularly since the crusher head assembly 18 would typically be accessible only from beneath any such crusher. Rotating the crusher bowl 45 with respect to the bowl flange 52 is found to be advantageous in that the operation is readily performed because of ready access to the outside of the crusher 10.

Removal of the bowl liner 46 may be effected either by removing the crusher bowl assembly in its entirety or by rotating the crusher bowl 45 upward and lifting it from its bowl flange 52. The bowl liner 46 becomes detached from the crusher bowl 45 by loosening locknuts 56 and releasing typical liner clamp hooks 57 which engage clamping ears 58 of the bowl liner 46.

The crusher head assembly 18 is a spherical pivot bearing type head assembly. A crusher head 60 is supported for gyratory motion along a spherically shaped bearing surface 61 of a crusher head base 62 nested within a complementarily concave spherical socket or seat 63. The crusher head 60 is of a frusto-conical configuration, simply referred to, though, as being of conical configuration. An outer conical wear liner or wear mantle 64 is fastened to a conical mantle support frame 66. The support frame 66 may be a unitary support member or may be comprised of separate structural elements including the crusher head base 62, an intermediate spacer disk 68, and a cap base 69, for example. The crusher head assembly also comprises a guide shaft 70 as part of the crusher head 60. The guide shaft 70 extends downward from the crusher head base 62, giving the crusher head 60 a resemblance of a mushroom. The crusher head 60 depicted in FIG. may be assembled by first inserting the guide shaft 70 through a central, counterbored aperture 71 in the crusher head base 62 and bolting a flange 72 at an upper end 73 of the guide shaft 70 to the base 62. The spacer disk 68 with the preattached cap base 69 may then be bolted centrally to an upper mounting surface 75 of the crusher head base 62. The outer conical wear mantle 64 would thereafter be placed over the mantle support frame 66. The wear mantle or liner 64 may include such ledges or mounting ears or hooks as may be deemed necessary to retain the particular shape and size of the mantle or liner 64 on the mantle support frame 66. Various provisions capable of securing the wear mantle 64 to the support frame 66 are known, including the use of clamping ears and corresponding clamping hooks, such as the ears and hooks 58 and 57 on the bowl liner 46. The wear mantle 64 is shown attached to the mantle support frame 66 by a clamping plate 78 driven downward by a clamping bolt 79 to urge the mantle 64 onto the frame 66. A cover plate 80 may be applied to protect the bolt 79 from impact forces of material falling onto the crusher head assembly 18.

The spherical seat 63 supports the crusher head 60 generally along the central axis 30, yet provides for spherical sliding movement of the base 62 along the curvature of the spherical bearing surface 61. Any such sliding movement of the crusher head 60 from a vertical results in an angular displacement or tilting of the crusher head 60 with respect to the central crusher axis 30. The amount of tilt of the crusher head 60 is measurable as angular deviation between the central crusher axis 30 and an axis 82 through the center of the crusher head 60. The radius of curvature of the spherical bearing surface 61 determines a position of an "apex" 83 at which the axes 30 and 82 intersect when the crusher head is tilted while remaining in full contact with the spherical seat 63. The position of the apex 83 remains fixed during gyratory motion of the crusher head 60. Gyratory motion of the crusher head 60 is a rotational displacement of a tilted orientation of the crusher head 60 about the central axis 30.

The spherical seat 63 is mounted to, or supported by, the head support frame 27. An interposed tubular spacer element 84 may be welded or otherwise fastened to an inner wall of the head support frame 27. The seat 63 is assembled to the spacer element 84 in a manner which supports the seat 63 centrally with respect to the axis 30, and which establishes crushing force transmitting contact from the crusher head 60 through the seat 63 and the spacer 84 to the head support frame 27. The seat 63 has a opening 85 which is also centered on the axis 30. The guide shaft 70 extends downward through the opening 85 into a cylindrical chamber 86. The cylindrical chamber 86 is bounded by an annular wall of a support cylinder 87, which may be a lower integral extension of the seat 63, or the cylinder 87 may be separate from, and function as an annular support for, the seat 63. The chamber 86 is also centered on the axis 30. The central opening or aperture 85 and the cylindrical chamber 86 are of a sufficiently large diameter to permit free angular displacement of the guide shaft 70 consistent with a maximum contemplated angular excursion of the guide shaft 70 during gyratory crushing action of the crusher head 60.

A radially disposed drive shaft 91 of the crusher drive assembly 20 is journalled in bearings 92 and 93. The drive shaft 91 is disposed within a tubular housing 94 which protects the shaft and bearings from contact by crushed materials, dust or the like. A pinion 95 at an inner end of the drive shaft 91 engages a horizontally disposed annular drive gear 96 which revolves about the central crusher axis 30. The drive gear 96 has internal splines 97 which slidably engage complementary splines 98 of an eccentric drive piston 99. The eccentric drive piston 99 is rotatably supported within the support cylinder 87.

In one currently contemplated embodiment the eccentric drive piston 99 may be comprised of an upper eccentric socket portion 100 and a lower sleeve portion 101. The eccentric socket portion 100 may be an assembled structure including a base 102 and a cap 103. In a preferred structure, the base 102 and the cap 103 both include machined semi-spherical cavities 104 and 105, respectively. The cavities 104 and 105 complement each other to form a spherical socket or eccentric bearing cavity 106 which retains a spherical bearing 107. The eccentric bearing cavity 106 is disposed at a predetermined distance of eccentricity from the center of the drive piston 99. The drive piston is centered on the central axis 30, such that the distance by which the eccentric bearing cavity 106 is offset from the center of the drive piston determines the amount of eccentricity of the bearing 107 with respect to the central axis 30. The bearing 107 has a bore 108 which extends on a diametrical axis through the bearing 107 and receives, and provides support for, the guide shaft 70. The guide shaft 70 extends through the bearing 107, through the eccentric socket portion 100 and toward the lower sleeve portion 101 of the eccentric drive piston 99. The drive piston 99 with the eccentric socket portion 100 and the spherical bearing 107 revolve as an assembly about the vertical crusher axis 30 to generate and control the gyration or gyratory movement of the crusher head 60. The bearing 107 retains the guide shaft 70 in its bore 108 to support it for relative rotation with respect to the drive piston 99. Though the combination of the drive piston 99 and the eccentric socket portion 100 results in a predetermined, fixed eccentricity of the socket portion 100 with respect to the vertical axis 30, it would also be possible to have the socket portion 100 disposed at an adjustably variable distance with respect to axis 30. For example, a double eccentric may be used to provide for such a variable eccentric displacement of the center of the bearing 107. The eccentric displacement of the socket portion 100 and of the bearing 107 tilts the guide shaft 70 and the crusher head 60 with respect to the vertical axis 30. Rotation of the drive piston 99 generates the desired gyration of the crusher head 60.

Gyration of the crusher head 60 generates relative motion of various intensity between several mutually adjacent ones of the described surfaces. Major surfaces which movably support the crushing head, for example the spherical bearing 61 and its corresponding seat 63, or those contributing to the generation of the gyratory motion, the guide shaft 70 and the bearing 107 and other load supporting surfaces with relative movement to adjacent surfaces are those surfaces which may desirably be lubricated by oil or equivalent lubricants pumped through typical feed pipes to the respective surfaces. Various acceptable ways of advantageously supplying lubricants or load carrying oils to the respective surfaces may be chosen. It is also known to protect working surfaces with seals, retaining lubricants and preventing abrasive material, such as dust, from getting between relatively movable adjacent surfaces. Strips of sealing material may be recessed in grooves peripherally disposed about major load bearing, movable surfaces. Particular detailed implementation of oil seals and of lubricating oil supply systems are contemplated to follow typical, known applications.

As an alternative to supporting loads with oil layers between load bearing surfaces, roller bearings may be employed in certain applications. The use of roller type bearings does not, however, eliminate the need for providing lubrication to the bearings. Also, the need to protect roller or ball bearings from dust, may cause a need for effective dust seals to take on particular significance. Various options may be chosen in providing effective lubrication to the components which exhibit relative motion an have a load supporting function.

The splines 97 of the drive gear 96 engage the corresponding splines 98 of the eccentric drive piston 99 to transmit a positive, rotational drive force from the drive gear 96 to the drive piston 99. The drive piston 99 rotates within the support cylinder 87 in response to a power input via the drive shaft 91 and the pinion 95. Additionally, the eccentric drive piston 99 is mounted for sliding movement within the support cylinder 87 coaxially with the central crusher axis 30, hence, for vertical movement within the crusher 10. The splines 97 and 98 remain in driving contact over a full range of vertical movement of the drive piston 99 within the support cylinder 87. It may be realized from the above that other positive drive arrangements may be used to impart rotary motion to the drive piston 99 and support the vertical sliding motion. However, splines are a well known device for combining axial sliding movement of shafts with rotary power transmission.

Figure 2:
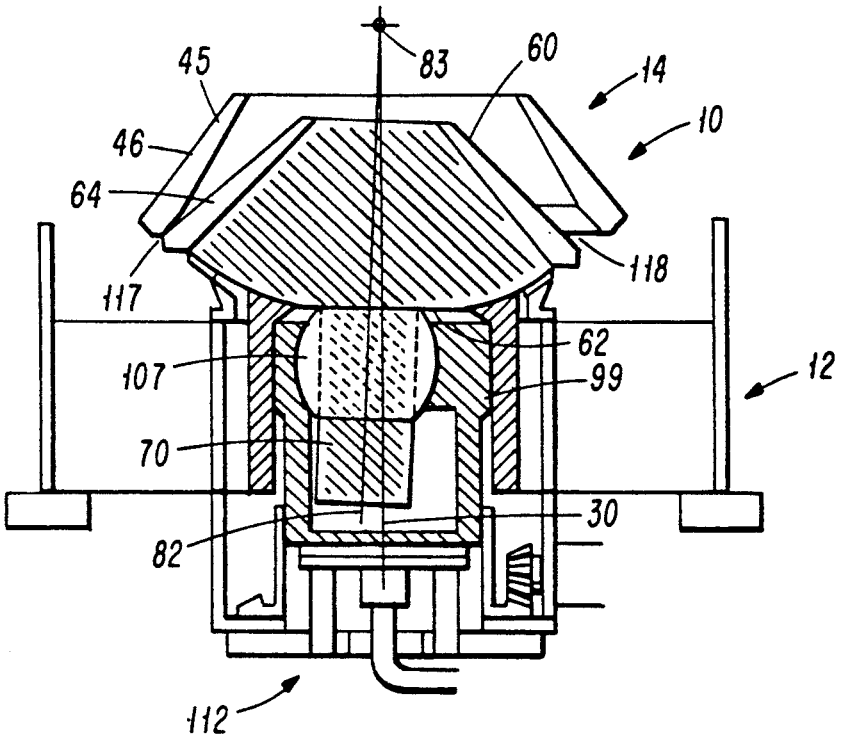
FIG. 2 is a simplified sectional view of a gyratory crusher illustrating schematically a mechanism for adjusting the stroke length of the crusher head, and showing the crusher head adjusted for a relatively long gyrational stroke excursion.
Figure 3:
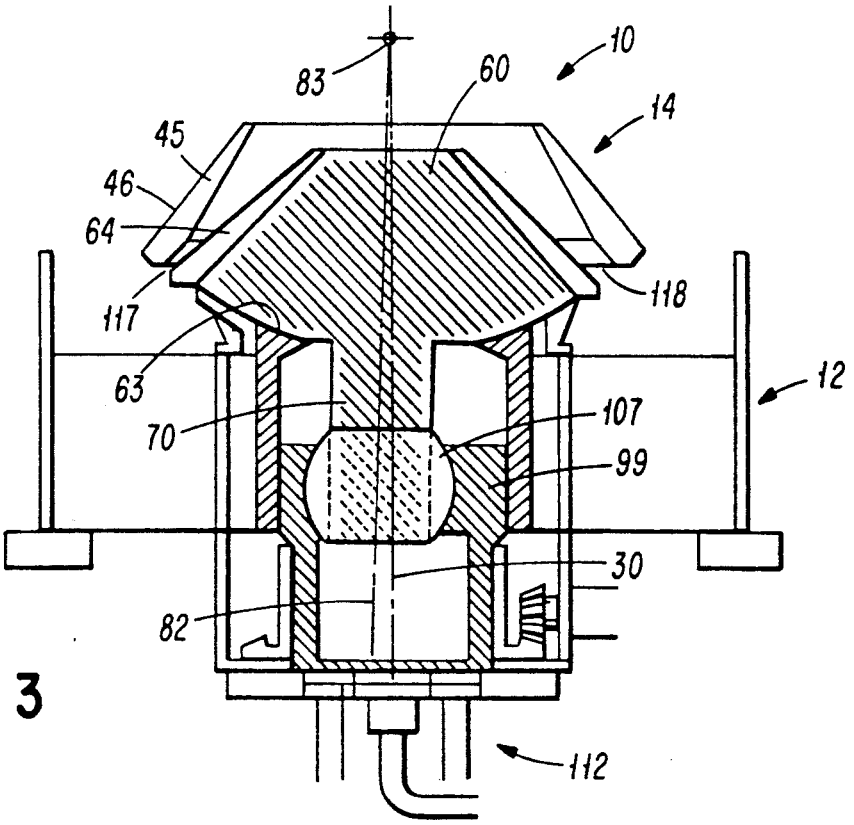
FIG. 3 is a simplified sectional view of a gyratory crusher as in FIG. 2, wherein the crusher head is set for a relatively short gyrational stroke excursion.

A positioning link 110 is shown attached through a thrust bearing 111 to a lowermost end of the drive piston 99. The thrust bearing permits the link 110 itself to remain stationary while the drive piston 99 is rotatably driven by the gear 96. The link 110 may be coupled directly to any vertical positioning mechanism as indicated by a double-headed arrow 112. For example, one embodiment of a positioning mechanism may be a hydraulic mechanism or arrangement 112. A hydraulic cylinder 113 (a portion of which is shown) may be coupled to and interact with the link 110 and vertically adjust the position of the link 110 to position, in turn, the drive piston 99 with respect to the crusher head assembly 18. An alternative embodiment of the positioning mechanism 112 may be a mechanical elevating linkage 112 as schematically shown in FIGS. 2 and 3.

The Crusher Operation

The eccentricity of the guide shaft 70 is determined by an offset "E" of the socket 106 away from the central axis 30 of the crusher 10. When rotational power is applied, as indicated by arrow 115, driving the drive shaft 91 and the drive gear 96, the drive piston 99 rotates within the support cylinder 87. The eccentric offset of the spherical bearing 107 from the central axis 30 drives the guide shaft 70 to move in a circular path about the central axis 30. Though it is possible to rotate the spherical bearing 107 within the drive piston 99, it is preferred to have relative rotation between the guide shaft 70 and the spherical bearing in driving the guide shaft 70 in this manner. The spherical bearing 107, however, pivots in a plane defined by the central vertical crusher axis and the axis 82 which defines the angle of deviation of the crusher head 60 with respect to the vertical axis 30. A vertical repositioning of the eccentric drive piston 99 with respect to the crusher frame assembly 12 changes the angle of deviation of the guide shaft 70. The eccentric bearing tilts accordingly to provide full counter support for developed crushing forces as the guide shaft 70 is driven through its gyratory movement by the eccentric drive piston 99.

As the drive shaft gyrates about the apex 83, the entire crusher head 60 gyrates about the apex 83 as the center of the bearing 107 describes the offset, circular path about the central axis 30. With an established distance to the apex 83, and any set height of the eccentric drive piston 99, the eccentricity "E" of the center of the spherical bearing 107 with respect to the central axis 30 maintains a constant angle of deviation of the crusher head 60 with respect to the central axis 30 of the crusher 10. The angle of deviation by the crusher head 60 from the vertical defines the stroke length of the crusher head 60. Total angular displacement of the guide shaft 70 at the center of the bearing 107 over a single revolution of the drive piston 99 amounts to twice the angle whose tangent is defined by the ratio of the eccentricity "E" divided by the distance from the center of the socket 106 to the apex 83. All other elements of the crusher head 60 undergo the same total angular displacement as that of the guide shaft 70.

The stroke of the crusher head 60 is measured as the difference between the high point of gyration of the mantle 64 toward the bowl liner 46, its closed side setting (CSS) indicated at 117 and the maximum gap across the same section. Of course while any one peripheral position is at the CSS 117, diametrically opposite from the minimum crusher gap setting 117, a crusher gap 118 is at its maximum or at an open position.

The gyratory crusher 10 is distinct with respect to other gyratory crushers by the vertical adjustment capability of the eccentric drive piston, the socket 106 and the corresponding spherical bearing 107. FIG. 1 shows the bearing support cavity or socket 106 to be at a high end of its vertical adjustment range. A vertical downward adjustment of the drive piston 99 and its eccentric socket portion 100 does not affect the vertical position of the crusher head 60 Instead, a downward adjustment of the drive piston 99 lengthens the distance between the apex 83 and a portion of the guide shaft 70 through which the eccentric socket portion 100 controls the deviation of the guide shaft 70 with respect to the central axis 30. The downward adjustment of the eccentric socket portion 100 decreases the stroke defining angle of deviation of the crusher head axis 82 from the central axis 30. As a result the stroke of the crusher head 60 is shortened as the drive piston is moved downward with respect to a prior upper position. Conversely, when the drive piston 99 is in a comparatively low position, the link 110 may raise the drive piston 99 within the support cylinder 87 to lengthen the stroke of the crusher head 60. It is to be noted that an axial adjustment of the drive piston 99 with respect to the apex 83 results in an angular change of the support bearing 107 within the socket 106 about an axis of rotation which is orthogonal to the crusher head axis 82 centrally through the guide shaft 70. A function of the support bearing 107 is to permit relative rotation between the drive piston 99 and the guide shaft 70 while distributing lateral crushing loads at the interface between the guide shaft 70 and the drive piston 99. What is more significant, however, is that lateral crushing forces exerted by the guide shaft 70 against the support bearing 107 continue to be uniformly distributed through the support bearing 107 with respect to the drive piston 99, even though the angular relationship of the drive piston 99 and the guideshaft 70 may change as a result of adjustment of the stroke. The spherical external shape of the support bearing 107 provides for substantially uniform force distribution over the range of relative movement among the drive piston 99, the spherical support bearing 107 and the guide shaft 70.

It will be understood by those skilled in the art that a lengthening or shortening of the crusher stroke as provided for may also require an adjustment of the closed side setting 117 to prevent an overload on the crusher 10. A closed side setting adjustment is readily accomplished by rotating the crusher bowl 45 with respect to the bowl flange 52 to raise or lower the crusher bowl 45 with respect to the crusher head 60. The same adjustment is routinely performed on other known crushers to compensate for wear on the bowl liner 46 and the mantle 64. A longer stroke has been found to increase the production capacity of the crusher 10. Such increase in stroke length may optimize the crushing operation of the crusher 10 when the materials to be comminuted are easy to crush when compared to other crushable materials. Hence, the stroke adjustment allows the crushing operation to be optimized with respect to the characteristics of currently available materials. The increased production capacity or material flow through may require a gap increase at the closed side setting to accommodate increased material flow. Also, a nominal increase in the crusher speed or an increase in the available power to drive the crusher 10 may be desired. A shortening of the stroke length may conversely become necessary to again optimize the operation with respect to comminution of a harder material as compared to a previously available material.

A contemplated embodiment may, for example have a deviation range of the guide shaft 70 between 2 and 2.6 degrees. The crusher stroke may accordingly vary between 1.6 and 2.3 inches. Of course, these stroke adjustment ranges are given as an example only, and are not to be considered limiting to the scope of the invention. Another crusher 10 in accordance with the invention may provide a stroke adjustment with a range of between 2 and 3 inches, for example.

FIGS. 2 and 3 are partial schematic representations of the crusher 10 showing, respectively, one of two different adjustment settings of the drive piston 99 within the support cylinder 87 to further illustrate the described stroke adjustment provisions. In FIG. 2, the spherical bearing 107 is disposed at an uppermost end of the guide shaft 70 as it extends from the crusher head base 62. The positioning mechanism 112 supports the eccentric drive piston 99 in a correspondingly uppermost position to render the crusher head axis 82 at a maximum deviation with respect to the central crusher axis 30. At this setting the bowl liner 46 is adjusted vertically for a minimum gap setting at the closed side setting 117 with respect to the wear mantle 64.

In FIG. 3 the positioning mechanism 112 has positioned the drive piston 99 at substantially a lowermost position with respect to the crusher frame assembly 12. The seat 63 still positions the crusher head 60 at the same height with respect to crusher frame assembly 12. The apex 83 at which the centerline or axis 82 of the crusher head intersects the central axis 30 of the crusher remains stationary with respect to the crusher frame 12. However, the deviation of the axis 82 from the axis 30 decreased, hence the angle of gyration of the crusher head 60 about the central axis 30 is less. As a result of the downward adjustment of the drive piston 99 the stroke of the crusher head has become less. Concurrently with the decrease of the angular deviation of the crusher head 60 with respect to the central crusher axis 30 the closed side setting and the maximum open setting between the wear mantle 64 and the bowl liner 46 have changed. The closed side setting at 117 in FIG. 3 has increased with respect to the closed side setting shown at 117 in FIG. 2, showing, of course, the bowl liner 46 in the original position as also depicted in FIG. 2. Conversely, the maximum gap setting at 118 diametrically across the closed side setting 117 has decreased. The stroke length of gyratory movement of the crusher head 60 has consequently been decreased by a distance which is the sum of the increase of the closed side setting 117 and the decrease of the maximum gap setting 118 in FIG. 3 over the corresponding settings shown in FIG. 2.

If an increase in the stroke length of the crusher head 60 is desired, it may be prudent to first adjust the closed side setting 117 to increase the gap between the bowl liner 46 and the crusher head mantle 64 prior to moving the drive piston 99 upward within the support cylinder 87. After adjusting the angle of deviation of the crusher head 60 from the central axis 30, a fine tuning of the closed side setting adjustment may be necessary.

Various changes and modifications of the described apparatus are possible without departing from the spirit and scope of the invention. It is to be realized that other gyratory crushers adjust the closed side setting, such as at 117, by vertically moving the respective crusher heads instead of adjusting the bowl liner 46 as described with respect to FIG. 1. It is possible to use the present invention with either type of gyratory crusher. Also, various types of crusher heads, such as short heads and long heads are used for different types of crushing requirements. The invention is applicable to gyratory crushers with either short or long crusher heads. It is furthermore possible to apply the invention advantageously to different types of gyratory crushers, though a different crusher head gyration mechanism may necessitate some changes in the arrangement of the described elements for adjusting the crusher stroke length. The advantage of varying the stroke length applies generally to gyratory crushers regardless of the mechanism by which the gyratory motion of the crusher head is produced. The particular structure of a gyratory crusher 10 and stroke control arrangement may use a cylindrical coupling member in lieu of a spherical bearing to seat the guide shaft 70 for rotation within the drive piston 99. The described structure is therefore set forth as an example of a currently preferred apparatus embodying the features of the present invention and not as a limitation to its scope.

What is claimed is:

1. A method of crushing materials with a gyratory crusher, the gyratory crusher including a crusher bowl centered on a central vertical crusher axis, a crusher head disposed below the crusher bowl, and a gyratory drive including a bearing for retaining the crusher head at a predetermined angle of deviation with respect to the central vertical crusher axis for gyratory motion of the crusher head at a defined angle of deviation about the central vertical crusher axis, the method comprising the preparatory steps of:

adjusting the position of the bearing within the gyratory crusher and thereby adjusting the defined angle of deviation of the crusher head and a stroke length of gyration of the crusher head of the gyratory crusher; and verifying that a minimum desirable opening exists at a closed side between the crusher bowl and the crusher head, and adjusting the opening at the closed side to a minimum desired open setting if the minimum desirable opening does not exist after adjusting the stroke length of gyration of the gyratory crusher.

2. The method of crushing materials according to claim 1, wherein adjusting the position of the bearing and the stroke length comprises adjusting the height of an eccentric drive piston supporting the bearing along the central vertical crusher axis and the bearing along the length of a guide shaft extending downward from a crusher head, thereby changing the defined angle of deviation of the crusher head with respect to the central vertical crusher axis.

3. A gyratory crusher comprising:

a bowl assembly disposed centered on a central crusher axis, the bowl assembly having a concave crushing surface;

a crusher head assembly including a conical crusher head centered on a crusher head axis and disposed toward the concave crushing surface of the bowl assembly;

means for supporting the crusher head assembly generally along the central crusher axis for tilting movement of the crusher head with respect to an apex along the central crusher axis to support gyrational movement of the crusher head toward the bowl assembly;

drive means including an eccentric support bearing engaging the crusher head and means for supporting the eccentric support bearing at a predetermined distance of eccentricity from the central crusher axis for generating an angular deviation of the crusher head axis with respect to the central crusher axis and for driving the crusher head in a gyrational orbit about the apex at an angular deviation to generate a gyrating stroke of the crusher head with respect to the bowl assembly; and means for controllably changing the angular deviation of the crusher head axis with respect to the central crusher axis.

4. The gyratory crusher according to claim 1, wherein the means for supporting the eccentric support bearing comprises a drive piston, and the crusher head comprises a guide shaft extending from the crusher head into the drive piston, the guide shaft of the crusher head rotatably engaging the eccentric support bearing, the eccentric support bearing rotatably retaining the guide shaft at the predetermined distance with respect to the central crusher axis, and wherein the means for controllably changing the angular deviation of the crusher head axis comprises means for vertically moving the drive piston with respect to the apex.

5. The gyratory crusher according to claim 1, wherein the drive means comprises a drive piston centered on the central crusher axis, the drive piston being supported for rotation about the central crusher axis, the means for supporting the eccentric support bearing being a support cavity disposed within the drive piston, the support cavity being radially offset from the central crusher axis by a predetermined distance corresponding to the distance of eccentricity, and wherein the means for controllably changing the angular deviation of the crusher head axis comprises means for vertically adjusting the position of the drive piston with respect to the apex.

6. The gyratory crusher according to claim 5, wherein the crusher head comprises a guide shaft extending from the crusher head centrally through the eccentric support bearing into the drive piston, the guide shaft being journalled for rotation within the eccentric support bearing, and wherein the eccentric support bearing is mounted for movement relative to the drive piston perpendicularly to an axis of rotation of the guide shaft with respect to the support bearing.

7. The gyratory crusher according to claim 6, wherein the bearing support cavity is a spherical cavity and the support bearing has an external spherical shape and a bore extending through the center of the spherical shape, the bore adapted to rotationally support the guide shaft.

8. The gyratory crusher according to claim 7, wherein the means for vertically adjusting the position of the drive piston with respect to the apex comprises a drive link coupled to the drive piston and actuator means for raising and lowering the drive link with respect to the apex to thereby adjust the position of the drive piston accordingly.

9. A gyratory crusher comprising:

a crusher frame assembly having a central vertical axis and including a support structure for supporting a crusher head along the central vertical axis;

a crusher head supported by the frame assembly along the central vertical axis, the crusher head including a guide shaft extending downward from the crusher head into the frame assembly;

an eccentric drive member mounted within the frame assembly concentric with the central vertical axis, the frame assembly including bearings for rotatably supporting the eccentric drive member to rotate on the central vertical axis, the eccentric drive member including an eccentric bearing having a bore displaced from the central vertical axis for retaining the guide shaft of the crusher head at an angle of deviation with respect to the central vertical axis;

a drive mechanism engaging the eccentric drive member to rotate the eccentric drive member and to gyrate the guide shaft with respect to the central vertical axis; and a positioning mechanism coupled to the eccentric drive member, the positioning mechanism supported with respect to the crusher frame assembly and including a drive link coupled to the eccentric drive member to reposition the eccentric bearing and change the angle of deviation of the guide shaft with respect to the central vertical axis, whereby a stroke length of gyration of the crusher head changes.

10. The gyratory crusher according to claim 9, wherein the eccentric bearing is mounted for movement in a plane of the central vertical axis and an axis of deviation of the guide shaft disposed within the bore of the eccentric bearing.

11. The gyratory crusher according to claim 9, wherein the crusher frame assembly comprises a support cylinder having a cylindrical chamber centered on the central vertical axis, the eccentric drive member comprises an eccentric drive piston disposed within the cylindrical chamber for vertical movement, and the drive link of the positioning mechanism is a vertical drive link coupled to move the eccentric drive piston through a range of vertical positions, thereby changing the angle of deviation of the guide shaft with respect to the central vertical axis.

12. The gyratory crusher according to claim 11, wherein the eccentric drive member includes a spherical socket for supporting the eccentric bearing and the eccentric bearing is externally of an essentially spherical shape with the bore extending axially through the eccentric bearing.

13. The gyratory crusher according to claim 9, comprising a bowl assembly disposed centered on the vertical crusher axis above the crusher head, the gyratory crusher further comprising an adjustment mechanism for adjusting the vertical height between the bowl assembly and the crusher head to a desired closed side setting between the crusher head and the bowl assembly.

14. The gyratory crusher according to claim 13, wherein the bowl assembly comprises a crusher bowl and a bowl flange supporting the crusher bowl with respect to the crusher frame assembly, and the adjustment mechanism for adjusting the vertical height comprises complementary helical threads on the bowl flange and on the crusher bowl for adjusting the crusher bowl vertically with respect to the crusher frame assembly.

15. The gyratory crusher according to claim 14, wherein the crusher frame assembly comprises a support cylinder having a cylindrical chamber centered on the central vertical axis, the eccentric drive member comprises an eccentric drive piston disposed within the cylindrical chamber for vertical movement, and the drive link of the positioning mechanism is a vertical drive link coupled to move the eccentric drive piston through a range of vertical positions, thereby changing the angle of deviation of the guide shaft with respect to the central vertical axis.

16. The gyratory crusher according to claim 13, wherein the eccentric drive member comprises a spherical socket for supporting the eccentric bearing and the eccentric bearing is of complementary spherical shape, the bore of the eccentric bearing extending diametrically through the eccentric bearing.

* * * * *

UNITED STATES PATENT AND TRADEMARK OFFICE

CERTIFICATE OF CORRECTION

PATENT NO. : 5,312,053

DATED : May 17, 1994

INVENTOR(S) : Ganser, IV

It is certified that error appears in the above-identified patent and that said Letters Patent is hereby corrected as shown below:

In Column 4, line 7: after "FIG.", insert --1--.

In Column 5, line 14: after "FIG.", insert --1--.

In Column 7, line 29: after "motion", delete "an" and insert --and-- therefor.

In Column 8, line 56: after "60", insert --.--.

In Claim 4, Column 11, line 62: after "claim", delete "1" and insert --3-- therefor.

In Claim 5, Column 12, line 6: after "claim", delete "1" and insert --3-- therefor.

In Claim 16, Column 14, line 24: after "claim", delete "13" and insert --15-- therefor.

Signed and Sealed this

Thirteenth Day of September, 1994

*Attest:*

*Attesting Officer*

BRUCE LEHMAN

*Commissioner of Patents and Trademarks*